US005154684A

United States Patent [19]

Delf

[11] Patent Number: 5,154,684

[45] Date of Patent: Oct. 13, 1992

[54] EXERCISE APPARATUS FOR THE HUMAN BODY

[76] Inventor: Eric W. Delf, 10 Hall Lane, Chelmsford, Essex, Great Britain, CM2 7RQ

[21] Appl. No.: 655,407

[22] PCT Filed: May 4, 1990

[86] PCT No.: PCT/GB90/00694

§ 371 Date: Mar. 27, 1991

§ 102(e) Date: Mar. 27, 1991

[87] PCT Pub. No.: WO90/14864

PCT Pub. Date: Dec. 13, 1990

[30] Foreign Application Priority Data

Jun. 5, 1989 [GB] United Kingdom ..... 8912917
Jan. 17, 1990 [GB] United Kingdom ..... 9001041

[51] Int. Cl.[5] ..... A63B 21/015
[52] U.S. Cl. ..... 482/116; 482/118; 482/123

[58] Field of Search ..... 272/117-118, 272/129, 130, 131-143, 93, 99, 102, 103, 114, 115, 116, 117, 118, 119, 903, 123, 125, 130

[56] References Cited

U.S. PATENT DOCUMENTS

| | | | |
|---|---|---|---|
| 1,019,861 | 3/1912 | Titus | 272/138 |
| 2,128,332 | 8/1938 | Schollmeyer | 272/142 X |
| 3,599,974 | 8/1971 | Price | 272/132 |
| 3,615,092 | 10/1971 | Stubbmann | 272/136 |
| 3,687,450 | 8/1972 | Schollmeyer | 272/137 |
| 3,741,538 | 6/1973 | Lewis et al. | 272/133 X |
| 3,785,644 | 1/1974 | Bradley et al. | 272/132 X |
| 3,861,215 | 1/1975 | Bradley | 272/132 X |
| 4,479,647 | 10/1984 | Smith | 272/129 X |
| 4,685,670 | 8/1987 | Zinkin | 272/136 |
| 4,801,139 | 1/1989 | Vanhoutte et al. | 272/134 X |

*Primary Examiner*—Robert Bahr
*Attorney, Agent, or Firm*—Fred Philpitt

[57] ABSTRACT

The apparatus comprises a base and a pull bar. A cord is attached to the ends of the pull bar, and the cord is guided over a floating pulley. The pulley is in turn connected to an energy dissipating device so that they pull on the cord lengths at the ends of the bar.

8 Claims, 2 Drawing Sheets

EXERCISE APPARATUS FOR THE HUMAN BODY

Figure 1:
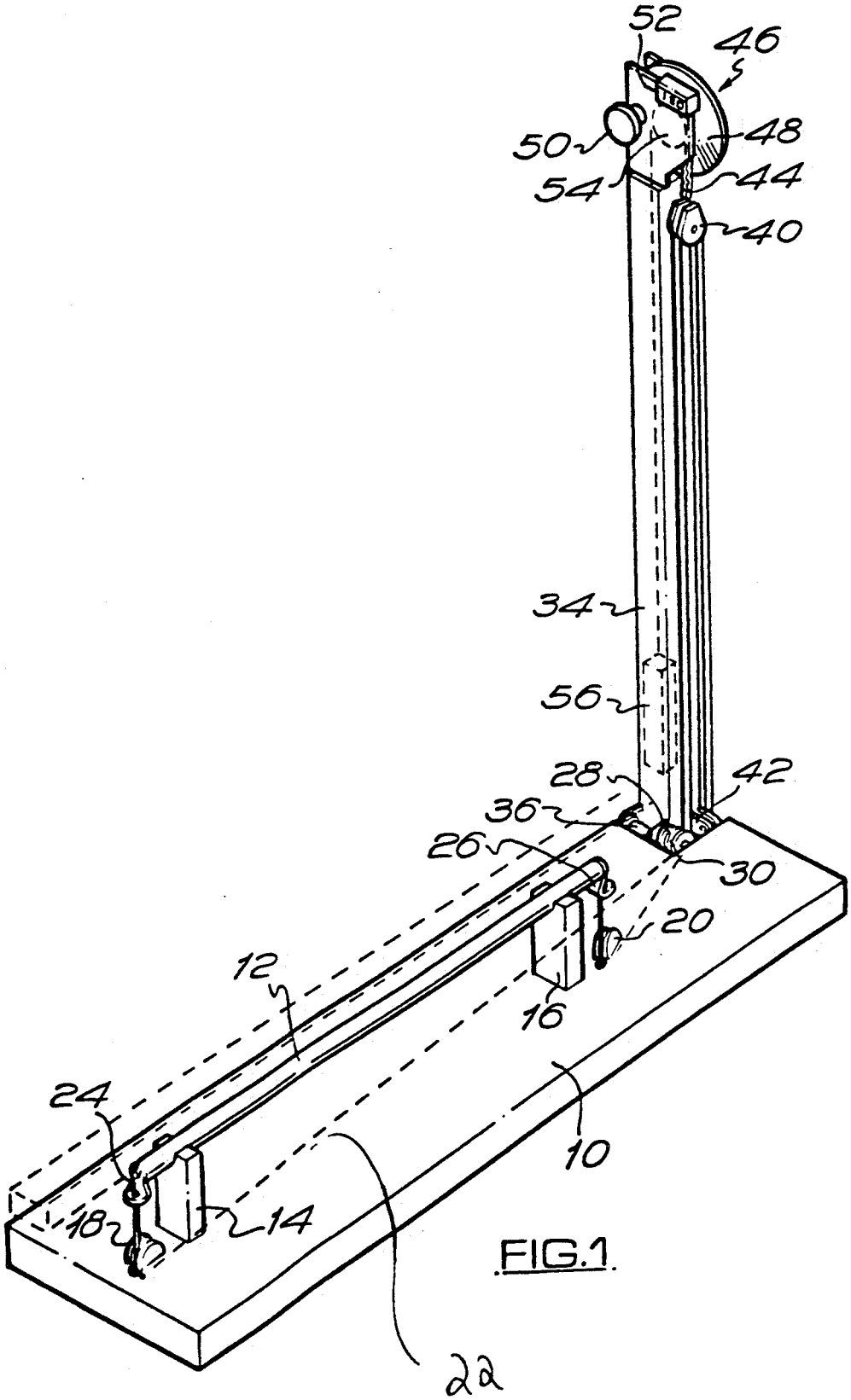

This invention relates to exercise apparatus for the human body.

With the increase in leisure time and the general increase in wealth of individuals at least in developed countries, there is a substantial tendency towards the taking of exercise during ones leisure time.

Many people prefer to take their exercise for the benefit of their health and general fitness, indoors, and in the privacy of their own home. Consequently, there has been an explosion in the sale of exercise apparatus for the human body, such exercise apparatus including spring loading machines, cycling machines, rowing machines, step-up machines, twisting machines, weight lifting stands and benches, multi-gym apparatus, and so on.

The present invention provides another form of apparatus which does not suffer from a recently identified problem of the existing apparatus. The aforementioned problem applies in particular to weight lifting stands and benches and multi-gym apparatus involving the movement of weights, and also involves that type of spring loading machine where the user in applying effort to the machine, converts his energy into energy stored in a compression or tension spring. The danger which arises with such apparatus is that the energy imparted to the apparatus by the user frequently is stored in potential or spring energy form. For example in the lifting of weights when a user performs a bench press or otherwise lifts the weights, the elevated weights have considerable potential energy, and if the user experiences difficulty in sustaining the weights in elevated condition or raising them to the elevated position, there is a danger that the weights will fall on top of the user imparting serious damage. The same applies when the user's energy is stored in a spring, because if the apparatus is released too quickly, then the spring energy will also be released, and the apparatus can become dangerous.

It is appreciated that not all exercise machines have this problem, but the machines which do not have the problem tend to be rather limited in their utilisation and comprise machines such as exercise cycles and rowing machines, which enable the user to perform only one exercise function or operation.

The present invention seeks to provide an exercise apparatus wherein the problem mentioned above does not occur, and which at least in its preferred form is capable of being embodied in a machine which can be utilised for a number of different body exercises.

In accordance with the present invention there is provided an exercise apparatus for the human body which includes an energy dissipating device which is operable by human efforts in one direction from an initial position and has automatic return means which returns the device to the initial position upon release of the human effort, and wherein the apparatus comprises a base on which the user stands, a lift bar above the base, which can be lifted by the user from the base upon performing an exercise; first and second said means connected operatively between the respective ends of the bar to the energy dissipating device, characterised in that the first and second said means are trained round a floating pulley block which is in turn connected to the energy dissipating device so that the displacement of the said means at the respective ends of the bar upon lifting of same effect displacement as opposed to be directly connected to the energy dissipation means whereby a single energy dissipating means is operated by the displacement of the first and second said means by movement of the bar.

As compared to conventional weight lifting apparatus, apparatus according to the invention may be low in weight to allow simpler transport and delivery, and lower weight leads to easier installation insofar as the apparatus exerts negligable floor loading on the supporting surface, at least in comparison with the commonly used weight lifting multi-gyms. The apparatus according to the invention can offer all classic bar bell exercises in one machine and it can be made compact and collapsible to allow for portability and easy storage, for example under a bed or in a cupboard.

The apparatus according to the invention can be used as a means of providing exercise for the human body for the purpose of muscular development and/or improvement of physical fitness.

Figure 2:
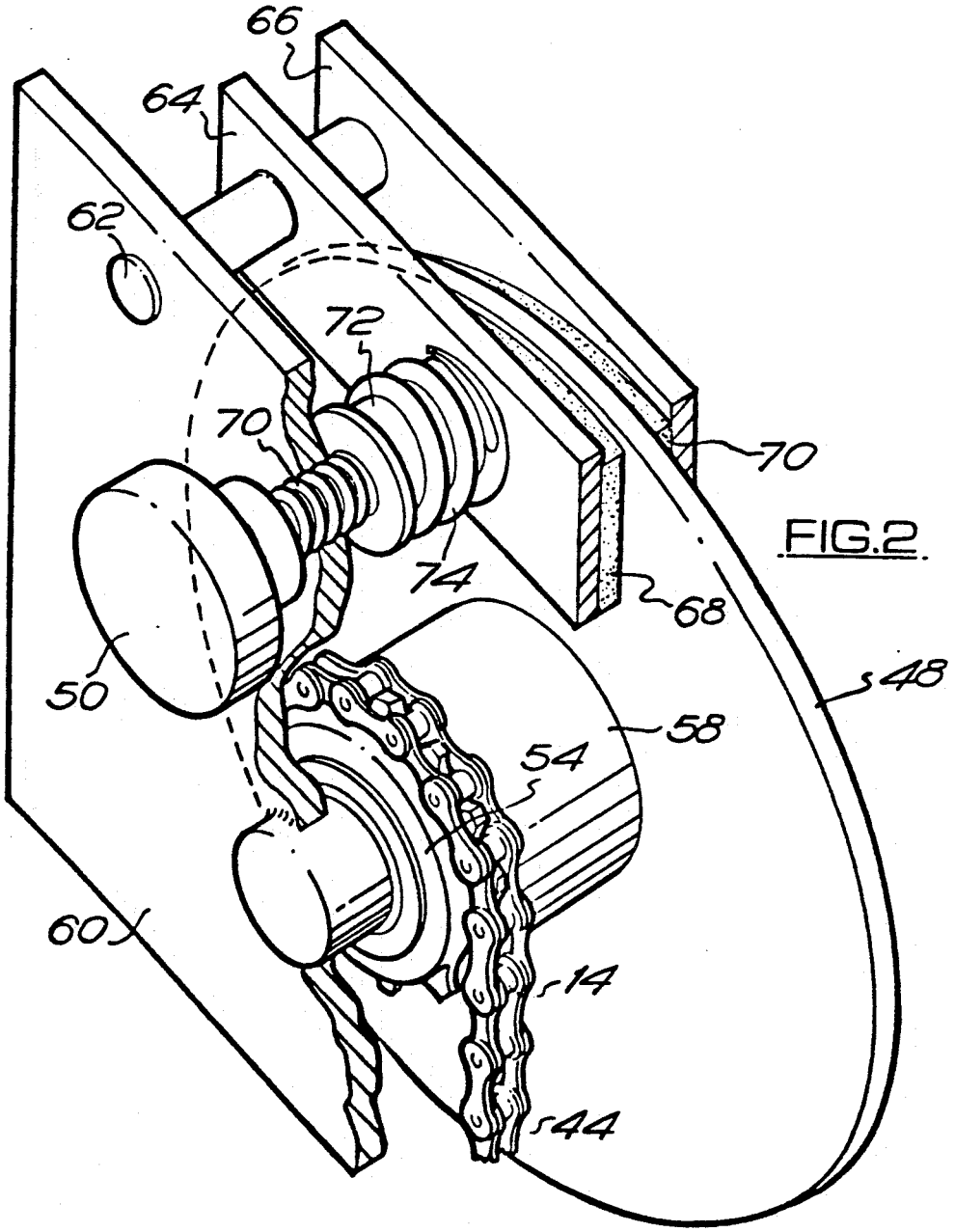

An embodiment of the invention will now be described, by way of example, with reference to the accompanying drawings, wherein:

FIG. 1 is a perspective view of an exercise apparatus according to the embodiment of the invention;

FIG. 2 is a broken away perspective view of the energy dissipating device of the apparatus of FIG. 1; and Referring to the drawings, and firstly to FIG. 1, an exercise apparatus is shown which is in the nature of a multi-gym apparatus for weight lifting, and comprises a base board 10 on which is supported a pull bar 12 by means of support blocks 14 and 16 which are carried by the top of the board 10 as shown.

The board 10 houses a pair of guide pulleys 18 and 20 around which is trained a cord 22, the ends of which are connected by brackets 24, 26 to the bar 12. The cord 22 also passes round further guide pulleys 28, 30 located at the bottom of a post 34 which is pivotally mounted about a pivot bracket 36 at the corner of the board 10 as shown, and the cord or rope 22 further passes round a floating pulley block 40 which is also for guiding the rope 22, and finally the rope 22 passes round a fixed guide pulley 42 at the lower end of the post 34.

The post 54 can be folded as shown in FIG. 1 in dotted lines onto the board 10 about the pivot axis 36 to move the apparatus to a collapsed and relatively flat condition suitable for being stored in a cupboard or under a bed.

Pulley block 40 is connected in this embodiment by means of an elongated flexible member in the form of a length of chain 44 to an energy dissipating device 46, the detail of which is more fully illustrated in FIG. 2. The energy dissipating device 46 is in fact effectively a disc brake and the friction pad pressure applied to the disc 48 which is illustrated in FIG. 1 is adjusted by means of adjustment of the knob 50 also shown in FIG. 1. A meter 52 provides an indication of the friction force supplied to the disc 48.

To utilise the apparatus shown in FIG. 1, in one embodiment, the user, if he wishes for example to perform a squat or clean and jerk exercise, stands on the base 10 and grasps the bar 12 in the same way as he would if he were using conventional weights, and pulls on the bar 12. This in turn pulls the cord 22 which has the effect of pulling the pulley block 40 downwards and thereby rotating the disc 48 (as will be explained) against the friction applied by brake pad means, whereby the user inputs energy into the apparatus, and that energy is immediately dissipated in the form of heat in the region of the brake pad means. The apparatus is designed so that when the user releases the pull bar 12 (he will in fact lower it to the supports 14 and 16), the rope 22 returns to the position shown and the pulley 40 elevates to the position shown in FIG. 1 returning the apparatus to the initial position. This is achieved in the construction of the energy dissipating device and accompanying components as will now be described, in relation to FIGS. 1 and 2.

As shown in FIGS. 1 and 2 the chain 44 is trained over a free wheel sprocket 54 which is concentric with the disc 48 and rotates about the axis of the disc 48, and at its other end the chain 44 is connected to a return weight 56 which is slidably contained in the post 34 and, in the FIG. 1 position, is at the lower end of the post 54. When the pull bar 12 is raised, the pulley 40 is pulled downwards and the weight 56 is in turn raised in the post 34. During this motion, the chain 54 moves in the direction of its length driving the sprocket 54 and also as shown in FIG. 2 driving through a drum 58, the disc 48. When the effort is released and the bar 12 is returned to the FIG. 1 position, the weight 56 drops in the post 34 moving the chain 44 in the opposite direction, and raising the pulley block 40 to the FIG. 1 position as shown, the sprocket 54 which forms a ratchet mechansim, free wheeling during this movement. The weight 56 is designed to be of a value simply to accomplish the return of the cord 22 and pulley 40 to the initial position. The ratchet mechansim may take any form which provides transmission of force or torque in one direction but not the other.

The device therefore operates as a one way energy application device, and when the user applies energy to the device it is dissipated in the friction between the disc brake and the disc 48, and the ratchet mechanism returns the apparatus to return to the initial position on a free wheel basis.

Referring now in more detail to FIG. 2, at the top of the post is provided a support plate 60 which carries the adjustment knob 50, and also supports the drum 58 and the disc 48 on a common axis.

A pin 62 extends from the plate 60, and supports a pair of disc brake plates 64 and 66 which lie to opposite sides of the disc 48. These plates 64 and 66 in turn support brake pads 68 and 70 which lie to opposite sides of the disc 48 and face same. The disc 48 does have a degree of freedom to move on its axis, and plate 64 is slidably carried on pin 62, but plate 66 is fixed to pin 62. The adjustment knob 50 is supported on a screw 70 having a plug 72 which supports a compression spring 74. The compression spring 74 acts against the plate 64 as shown, and if the knob 50 is appropriately turned, urges the plates 64 and 66 and their pads 68 and 70 and also the disc 48 to pack together frictionally with a force determined by the degree to which the spring 74 acts on plate 66. This force as will be understood can be adjusted by adjustment of the knob 50.

The apparatus of FIGS. 1 and 2 can be used for a wide range of exercises for the human body including, but not limited to biceps curl, forearm curl, bent over rowing, lower bench bends, side raises, one arm curl, wrist curl, one arm bent over rowing, dead lift, military press, french curl, reverse wrist curl, upright rowing, power clean and press, two arm front raise, calf raise, finger curl, trapezoid shrug, squats, short press and many more, and in no instance is the user in any danger from stored potential or spring energy in the apparatus.

The apparatus furthermore folds away compactly when not in use and the tension is infinitely variable at the simple rotation of a knob: there are no weights to change.

I claim:

1. An exercise apparatus for the human body comprising:

(a) a base on which the user stands;

(b) a lift bar above the base and which can be lifted by the user upon performing an exercise;

(c) first and second cord means respectively connected to opposite ends of the lift bar;

(d) a floating pulley block, said cord means being trained around said pulley block to displace same when the bar is lifted; and (e) energy dissipating and return means for dissipating the user's energy as the lift bar is raised from an initial position and for returning the bar to the initial position when the user's effort is released, said energy dissipating and return means comprising:

(i) a rotatable, energy dissipating device which dissipates energy when rotated in one direction; and (ii) an elongated, flexible, inextensible transmission member having one end connected to the floating pulley block and being trained around the energy dissipating device for the rotation of same in said one direction when the floating pulley block is displaced by lifting of the bar.

2. An exercise apparatus according to claim 1, wherein said first and second cord means are connected end-to-end to form a single length of cord or the like which is trained around said pulley block and of which the respective ends are connected to the respective ends of said bar.

3. An exercise apparatus according to claim 1 wherein there is a post at one end of the base, and the energy dissipating device is located at the top of the post, as is said pulley block, and wherein the first and second cord means are guided to the pulley block by intermediate guide pulleys.

4. An exercise apparatus according to claim 3 wherein said post is foldable onto said base for storage purposes.

5. An exercise apparatus according to claim 1 wherein the first and second cord means are trained around a fixed end guide pulley on said base after passing around said pulley block.

6. An exercise apparatus according to claim 3 wherein the first and second cord means are trained around a fixed end guide pulley on said base after passing around said pulley block.

7. An exercise apparatus according to claim 4 wherein the first and second cord means are trained around a fixed end guide pulley on said base after passing around said pulley block.

8. An exercise apparatus according to claim 1 wherein the flexible, inextensible member is a length of chain, the other end of which is connected to a return weight, and the energy dissipating device includes a sprocket and a one-way clutch drive, the sprocket being in driving engagement with the one-way clutch drive, and wherein the chain is trained over the sprocket, said weight being adapted to slide inside said post.

* * * * *